United States Patent [19]

Carter

[11] Patent Number: 4,494,340

[45] Date of Patent: Jan. 22, 1985

[54] HAND-HELD DUAL KNIFE SHARPENER

[75] Inventor: Larry D. Carter, Mosinee, Wis.

[73] Assignee: Oy Fiskars AB, Helsinki, Finland

[21] Appl. No.: 454,427

[22] Filed: Dec. 29, 1982

[51] Int. Cl.[3] ..... B24B 3/54

[52] U.S. Cl. ..... 51/214; 76/82

[58] Field of Search ..... 51/211–214, 51/285; 76/82, 82.2, 86, 88

[56] References Cited

U.S. PATENT DOCUMENTS

| | | | |
|---|---|---|---|
| 2,045,430 | 6/1936 | Winter | 76/82.2 |
| 2,509,636 | 5/1950 | Goldstein | 76/86 |
| 2,598,589 | 5/1952 | Murchison | 51/214 |

FOREIGN PATENT DOCUMENTS

| | | | |
|---|---|---|---|
| 408887 | 12/1970 | Australia | 51/214 |

*Primary Examiner*—Frederick R. Schmidt
*Assistant Examiner*—Robert Rose
*Attorney, Agent, or Firm*—James E. Nilles

[57] ABSTRACT

A hand-held dual knife sharpener comprises a gripping portion and an adjacent sharpener portion embodying coarse and fine sharpening devices on opposite sides thereof. The sharpener portion has two blade-receiving slots extending inwardly from the opposite sides and a sharpening device is located near the bottom of each blade-receiving slot. Each sharpening device comprises a pair of elongated blade sharpening elements arranged in converging and overlapping relationship to each other so as to define a V-shaped groove. The sharpener is fabricated of a pair of molded plastic mating components which are secured together and between which the four sharpening elements are entrapped.

4 Claims, 16 Drawing Figures

HAND-HELD DUAL KNIFE SHARPENER

BACKGROUND OF THE INVENTION

1. Field of Use

This invention relates generally to hand-held knife sharpeners and, particularly, to those which embody alternatively usable sharpening devices of different degrees of abrasiveness.

The present application relates or may relate to the following U.S. Patent Applications assigned to the same assignee as the present invention: U.S. Design patent application Ser. No. 454,438 filed Dec. 29, 1982 of Larry D. Carter and entitled Dual Knife Sharpener with Single Handle; and U.S. Design Patent Application Ser. No. 454,440 filed Dec. 28, 1982 of Daniel D. Call and entitled Dual Knife Sharpener with Dual Handle.

2. Description of the Prior Art

The prior art discloses many examples of hand-held sharpeners for kitchen knives or the like (see U.S. Pat. Nos. 1,573,879; 1,719,345 and 3,052,068, for example) and many examples of stationarily mounted or mountable knife sharpeners (see U.S. Pat. Nos. 620,050; 2,542,472; 2,473,702; 1,474,636; 1,827,664; 1,451,526; 1,032,910 and 1,223,753, for example).

SUMMARY OF THE INVENTION

In accordance with the invention there is provided an improved knife sharpener for sharpening kitchen knives or the like which is adapted to be hand-held during use.

The knife sharpener generally comprises a handle or gripping portion, a sharpener portion connected to the gripping portion and blade sharpening means on the sharpener portion. The sharpener portion includes a plurality (two) of blade sharpening means of differing abrasiveness (coarse and fine) which are located in spaced apart oppositely arranged locations on the sharpener portion, and includes a blade-guiding or blade-receiving slot for each of the sharpening means. More specifically, the sharpener portion has two blade-receiving slots extending inwardly from the opposite upper and lower side edges and a sharpening device is located near the bottom of each blade-receiving slot. Each sharpening device comprises a pair of elongated blade sharpening elements, preferably in the form of elongated ceramic cylinders, arranged in converging and overlapping relationship to each other so as to define a V-shaped groove at the bottom of the slot. The sharpener gripping and sharpener portions are fabricated of a pair of molded plastic mating components which are secured together and between which the four sharpening elements are entrapped. The two molded plastic components which are substantially mirror images of each other are sonic welded or otherwise together during manufacture. Each molding has a plurality of integrally formed receiving elements formed on the inside surface of its half of the end portion into which one of each pair of small elongated cylindrical ceramic sharpening elements is snap-fitted in a friction fit, instead of being sonic welded or glued.

A knife sharpener in accordance with the present invention offers several advantages over the prior art. For example, the sharpener gives the user the opportunity of using coarse or fine sharpening means of improved construction, as the situation requires, in the same implement. The sharpener is straight-forward in design and relatively easy and economical to fabricate and assemble. The sharpener employs improved state-of-the-art cylindrical sharpening elements which are firmly held in position by entrapment between the two molded halves of the sharpener without the need for adhesives. Other objects and advantages of the invention will hereinafter appear.

DRAWINGS

DESCRIPTION OF PREFERRED EMBODIMENTS

Figure 1:
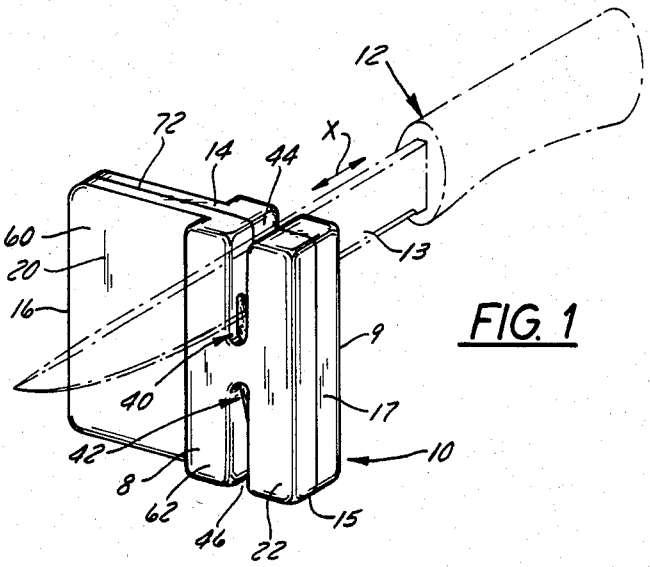
FIG. 1 is a perspective view of the front side and side edge of one embodiment of a knife sharpener in accordance with the invention.
Figure 6:
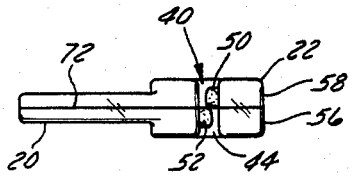
FIG. 6 is a top plan view of the upper side edge of the sharpener of FIG. 1.
Figure 4:
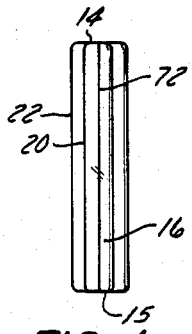
FIG. 4 is an elevation view of the left side edge of the sharpener of FIG. 1.
Figure 2:
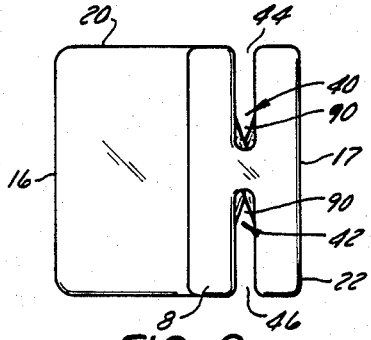
FIG. 2 is an elevation view of the front side of the sharpener of FIG. 1.
Figure 5:
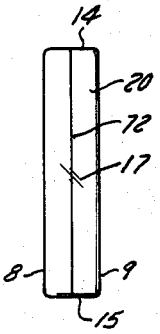
FIG. 5 is an elevation view of the right side edge of the sharpener of FIG. 1.
Figure 3:
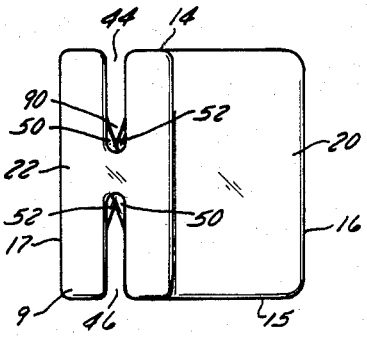
FIG. 3 is an elevation view of the rear side of the sharpener of FIG. 1.
Figure 7:
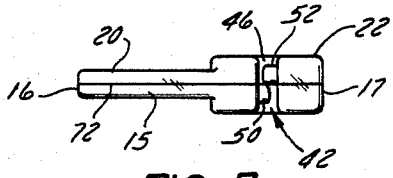
FIG. 7 is a bottom plan view of the lower side edge of the sharpener of FIG. 1.

FIGS. 1 through 7 pertain to a first embodiment of the invention, and FIGS. 8 through 14 pertain to a second embodiment of the invention. The FIGS. 15 and 16 pertain to structural elements which are understood to be employed in both embodiments. The reference numerals employed in the second embodiment to identify substantially similar elements in the first embodiment are the same, except for the addition of the prefix numeral "1". Because of the basic structural similarities between the two embodiments, only the first embodiment is hereinafter described in detail, except as otherwise noted.

Referring to FIGS. 1 through 7 and 15 and 16, in accordance with the invention there is provided an improved hand-held knife sharpener 10 for sharpening a kitchen knife 12 having a blade 13. The knife sharpener 10 comprises a handle or gripping portion 20, an end or sharpener portion or head 22 connected to the handle and blade sharpening means, hereinafter described in detail, on the sharpener portion.

The head 22 of the knife sharpener 10 includes a plurality (two) of blade sharpening means 40 and 42 of differing abrasiveness (coarse and fine) which are located in spaced apart oppositely arranged locations on the head 22. Head 22 includes a plurality (two) of oppositely disposed blade-receiving slots 44 and 46, one blade slot for each of the sharpening means. Knife sharpener 10 comprises a front side 8, a rear side 9, an upper side edge 14, a lower side edge 15, a left side edge 16, and a right side edge 17 (the terms "left" and "right" being with reference to FIG. 1). The blade slot 44 extends inwardly from upper side edge 14 and the blade slot 46 extends inwardly from lower side edge 15.

Each of the blade sharpening means 40 and 42 (which are of differing abrasiveness relative to each other) comprises at least one, but preferably two, blade sharpening elements 50 and 52, each in the form of a cylinder of ceramic abrasive, which are arranged in converging and overlapping relationship in a blade-receiving slot 44, 46 so as to be engageable by the sharp edge of the knife blade 13. The elements 50 and 52 are rigidly secured in place by entrapment, as hereinafter explained.

Figure 15:
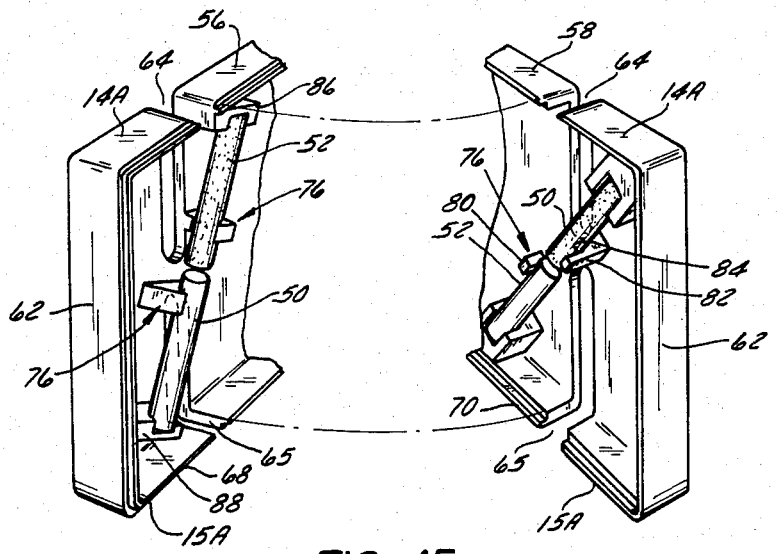
FIG. 15 is an enlarged exploded perspective view of the sharpener of FIGS. 1 through 7 showing interior details, components and arrangements employed therein, as well as in those employed in the sharpener of FIGS. 8 through 14.

As FIG. 15 best shows, the knife sharpener 10 comprises a pair of molded plastic components 56 and 58 which are substantially mirror images of each other. Each component 56, 58 comprises a handle or gripping section 60 and an integral head or sharpener section 62. The head section 62 of each of the components 56, 58 comprises a plurality (two) of spaced apart slot portions 64 and 65 extending inwardly from an upper edge 14A and a lower edge 15A of the component and transverse to the longitudinal axis of the component. Means are provided for securing the pair of components 56, 58 together in side-by-side relationship (FIGS. 3 and 4) whereby said components define handle 20 and head 22 having the two opposite blade-receiving slots 44 and 46 therein. As FIG. 15 shows, such means comprise interlocking flanges 68 and 70 on components 56 and 58, respectively, which are sonic welded together at seam 72.

Figure 16:
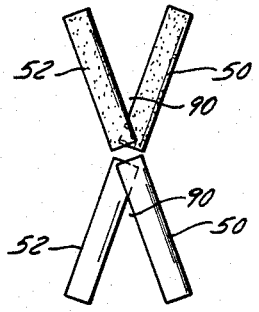
FIG. 16 is a side elevation view of the four sharpening elements of FIG. 15.

As FIGS. 15 and 16 show, each component 56, 58 has two pairs of integrally formed receiving elements 76 formed on the inside surface of its end portion 62 into which the cylindrical ceramic sharpening elements 50 and 52 are snap-fitted in a friction fit, instead of being sonic welded or glued. The blade sharpening means are thus secured by entrapment between pair of components 56, 58 when the latter are secured together. A portion of each element 50, 52 extends into its associated blade-receiving slot 44 or 46.

As FIGS. 15 and 16 show, each receiving element 76 into which a ceramic sharpening element 50, 52 is inserted comprises two spaced-apart projections or surfaces 80 and 82 which define a groove 84 for receiving the sharpening element. Axial shifting or displacement of an element 50, 52 is prevented by a wall surface 86 at one end and by an integrally formed projection 88 at its other end. The sharpening elements 50 and 52 forming a pair converge and overlap relative to each other to define a V-shaped groove 90 in the associated slot 44 or 46 which is accessible to the edge of the knife blade 13 which is to be sharpened. The sides of each slot 44, 46 guide the blade 13 as it is moved reciprocably therein transversely to axis X (FIG. 1) during sharpening.

Figure 8:
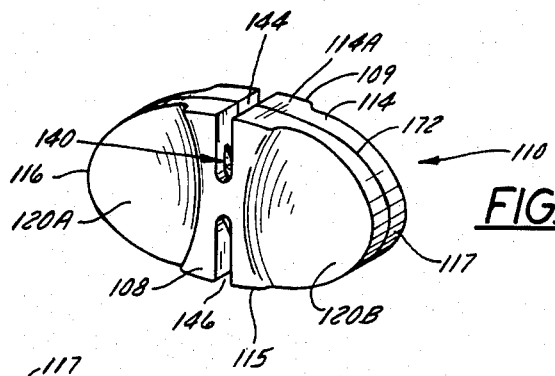
FIG. 8 is a perspective view of the front side and side edge of another embodiment of a knife sharpener in accordance with the invention.
Figure 13:
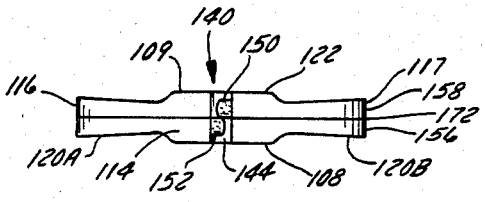
FIG. 13 is a top plan view of the upper side edge of the sharpener of FIG. 8.
Figure 11:
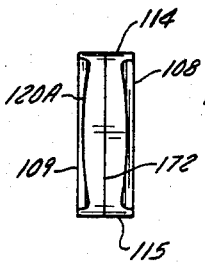
FIG. 11 is an elevation view of the left side edge of the sharpener of FIG. 8.
Figure 9:
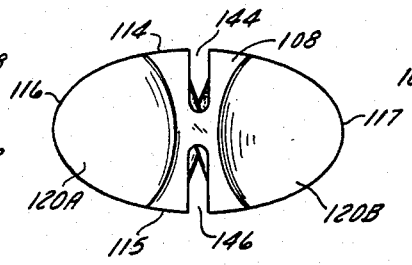
FIG. 9 is an elevation view of the front side of the sharpener of FIG. 8.
Figure 12:
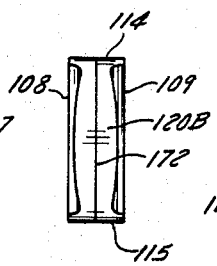
FIG. 12 is an elevation view of the right side edge of the sharpener of FIG. 8.
Figure 10:
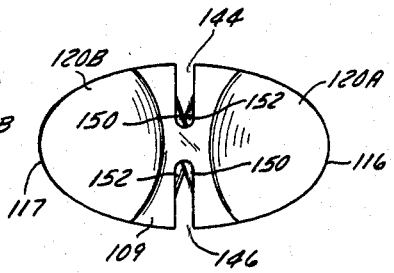
FIG. 10 is an elevation view of the rear side of the sharpener of FIG. 8.
Figure 14:
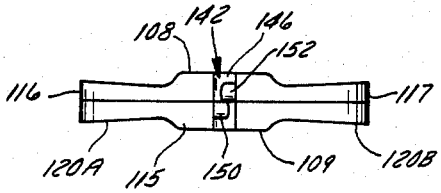
FIG. 14 is a bottom plan view of the lower side edge of the sharpener of FIG. 8.

In the first embodiment (knife sharpener 10), the gripping portion or handle 20 is located on one side of the slots 44 and 46. However, in the second embodiment (knife sharpener 110), the gripping portion or handle comprises two separate regions or dual handles designated 120A and 120B which are located on opposite sides of the slots 144 and 146, as FIGS. 8 and 9 show. This further enhances utility of the sharpener.

I claim:

1. A hand-held knife sharpener (10) comprising:

a gripping portion (20) and a hollow sharpener portion (22) integral with said gripping portion (20);

and blade sharpening means (40, 42) on said sharpener portion (22);

said blade-sharpening means (40, 42) including blade-receiving slots (44, 46) extending inwardly from opposite upper and lower edges (14, 15) of said sharpener portion (22);

said blade-sharpening means (40, 42) further including at least two pairs of elongated blade-sharpening elements (50, 52) of different abrasiveness rigidly mounted within said hollow sharpener portion (22) and the two elements (50, 52) in each pair of said elements (50, 52) intersecting one of said blade-receiving slots (44, 46);

said gripping portion (20) and said sharpener portion (22) comprising a pair of molded plastic components (56, 58), each of said components (56, 58) having an inner side and an outer side and comprising a gripping section (60), an integral sharpener section (62), flange means (68, 70) disposed along at least a portion of a peripheral edge of said sharpener section (62), slot portions (64, 65) extending inwardly from upper and lower peripheral edges (14A, 15A) of said sharpener section (62), and receiving elements (76) integrally formed on said inner side of said sharpener section (62);

said components (56, 58) further comprising means (72) for securing said components (56, 58) together in a relationship wherein said inner sides of said components (56, 58) confront each other and wherein said flange means (68, 70) interengage to define a space therebetween in said hollow sharpener portion (22);

said receiving elements (76) on one component (56, 58) supporting one blade-sharpening element (50, 52) of each pair, whereby said two pairs of blade-sharpening elements (50, 52) of different abrasiveness are secured in said space between said pair of components (56, 58) when the latter are secured together, and each pair of blade sharpening elements (50, 52) are arranged in converging and overlapping relationship relative to each other and extend into an associated blade-receiving slot (44, 46) so as to define a groove (90) which is located within a respective blade-receiving slot (44, 46).

2. A knife sharpener according to claim 1 wherein said components are secured together by a sonic weld.

3. A knife sharpener according to claim 1 wherein said gripping portion includes two separate regions disposed on opposite sides of said sharpener portion, each region being graspable independently of the other.

4. A knife sharpener according to claim 1 wherein said receiving elements receive said blade sharpening elements in a friction-fit.

* * * * *